US006316106B1

(12) United States Patent
Takasugi et al.

(10) Patent No.: US 6,316,106 B1
(45) Date of Patent: Nov. 13, 2001

(54) FILLER SAND FOR A LADLE TAP HOLE VALVE

(75) Inventors: Hideto Takasugi; Manabu Tano; Takeshi Ishii; Shinichi Akai; Akira Shirayama; Hirohisa Nakashima, all of Tokyo (JP)

(73) Assignees: NKK Corporation, Tokyo; Nippon Rotary Nozzle Co., Ltd., Yokohama, both of (JP)

( * ) Notice: Subject to any disclaimer, the term of this patent is extended or adjusted under 35 U.S.C. 154(b) by 0 days.

(21) Appl. No.: 09/230,140

(22) PCT Filed: May 21, 1998

(86) PCT No.: PCT/JP98/02240

§ 371 Date: Jan. 19, 1999

§ 102(e) Date: Jan. 19, 1999

(87) PCT Pub. No.: WO98/52708

PCT Pub. Date: Nov. 26, 1998

(30) Foreign Application Priority Data

May 23, 1997 (JP) ..... 9-148479

(51) Int. Cl.[7] ..... B32B 5/16; C04B 35/035

(52) U.S. Cl. ..... 428/402; 428/403; 428/404; 501/99; 501/132; 501/133; 501/154

(58) Field of Search ..... 428/402, 403, 428/404; 501/99, 122, 133, 154, 126, 132

(56) References Cited

U.S. PATENT DOCUMENTS 4,585,485 * 4/1986 Shikano et al. ..... 106/38.9
5,374,036 * 12/1994 Rogers et al. ..... 233/45
5,576,255 * 11/1996 Huard et al. ..... 501/122
5,962,357 * 10/1999 Kubota et al. ..... 501/99

FOREIGN PATENT DOCUMENTS 64-48662 2/1989 (JP) .
4-84664 3/1992 (JP) .
5-8022 1/1993 (JP) .
7-308763 11/1995 (JP) .
9-47863 2/1997 (JP) .

* cited by examiner

*Primary Examiner*—Hoa T. Le
(74) *Attorney, Agent, or Firm*—Frishauf, Holtz, Goodman, Langer & Chick, P.C.

(57) ABSTRACT

A filler sand for a ladle tap hole valve contains 70 to 90 wt % of chromite sand and 10 to 30 wt % of silica sand and is blended externally with 0.05 to 5 wt % of carbon black calculated based on the total amount of the chromite sand and the silica sand; or contains 70 to 90 wt % of chromite sand and 10 to 30 wt % of silica sand, wherein the chromite sand has a particle diameter distribution such that 99% or more of the chromite sand consists of particles having diameters ranging from 150 to 850 $\mu$m and that 95% or more of the chromite sand consists of particles having diameters ranging from 200 to 600 $\mu$m, and the silica sand has a particle diameter distribution such that 95% or more of the silica sand consists of particles having diameters ranging from 150 to 850 $\mu$m and that 80% or more of the silica sand consists of particles having diameters ranging from 200 to 600 $\mu$m.

20 Claims, 3 Drawing Sheets

FILLER SAND FOR A LADLE TAP HOLE VALVE

BACKGROUND OF THE INVENTION

Field of the Invention

The present invention relates to a filler sand filled in a ladle tap hole valve, such as a sliding nozzle or a rotary nozzle, which is used in tapping molten steel from a steel-making ladle etc.

BACKGROUND INFORMATION

A ladle for receiving molten steel is used in a ladle refining process or a continuous casting process carried out following a converter refining process, and a ladle tap hole valve (sliding nozzle or rotary nozzle) is arranged at the bottom of the ladle for tapping molten steel. In the ladle provided with such a ladle tap hole valve, to prevent molten steel from solidifying within a nozzle of the apparatus, the nozzle is charged with a refractory filler sand before receiving molten steel, and after molten steel is poured into the ladle, the nozzle is opened, whereby the filler sand falls freely, creating an opening by itself, or a free opening, through which the molten steel flows down.

Conventionally as such filler sand, silica sand ($SiO_2$:90 to 99%) is generally used. The purity of $SiO_2$ is adjusted as needed depending on use to prevent sintering (Unexamined Japanese Patent Piblication (KOKAI) No. 64-48662), or conversely, orthoclase ($K_2O.Al_2O_3.6SiO_2$) is added to cause sintering, thereby forming a viscous film in a region which comes into contact with molten steel to prevent penetration of the molten steel.

In the former case, however, although the filler sand can be prevented from sintering, penetration of molten steel cannot be effectively prevented, and thus no great improvement in the free opening ratio of the ladle can be expected. In the latter case, on the other hand, the filler sand can be used satisfactorily in ordinary operation, but in cases where molten steel needs to be processed at high temperature for a long time in ladle refining, etc. to produce high-grade steel, sintering of the filler sand itself progresses to such an extent that an unyielding film is formed, with the result that the free opening very often fails to be created. If non-free opening is created, it is necessary that oxygen be blown from below with a long nozzle detached, to forcibly make an opening. However, contact of molten steel with air adversely affects the quality of the resulting steel, and thus the grade down of steel or scrap is produced, causing a great deal of damage.

To solve the problem, attempts have recently been made to admix the filler sand with flake graphite or earthy graphite, taking account of properties of graphite, that is, the property of inhibiting sintering and the property of being less wettable by molten steel. However, segregation is caused by a phenomenon occurring before graphite is put to use and is contained in a hopper, paper bag or container bag, such as by a difference in specific gravity or good sliding property of graphite, and thus expected results are not achieved yet in practice. Attempts have also been made to use pitch, but the use of pitch is not preferred because it has a 30 to 70% content of volatiles, gas is produced during use, and because segregation occurs.

There has also been proposed to add 0.05 to 5.0 wt % of carbon black to a filler sand such as silica sand, MgO clinker or zircon sand (Unexamined Japanese Patent Publication No. 4-84664). Carbon black has a high percentage of residue, has a small content of volatiles, and is excellent in preventing sintering and preventing penetration of molten steel, compared with the blending material such as flake or earthy graphite, pitch, etc. Also, since carbon black has a large specific surface, it shows excellent dispersion when added to the filler sand and can prevent segregation. Further, carbon black is excellent in adhesion to silica sand. Filler sand admixed with carbon black is therefore regarded as a potential material having excellent properties required of the filler sand, such as the property of preventing sintering and penetration of molten steel.

However, although the filler sand disclosed in Unexamined Japanese Patent Publication No. 4-84664 is effective in some degree, the free opening ratio during a high tapping temperature and long lead time process involving ladle refining is not of a satisfactory level, and thus there is a demand for a filler sand which ensures a high free opening ratio even under such severe conditions.

As such filler sand, chromite sand having a higher melting point than silica sand is also used. However, chromite sand becomes sintered when molten steel is tapped, and the opening often fails to be created; therefore, chromite sand is seldom used singly and is used in combination with silica sand.

Even such a filler sand having chromite sand mixed with silica sand does not ensure a satisfactory free opening ratio in a high tapping temperature and long lead time process involving ladle refining. Also, the filler sand is liable to be sintered to the surface of a well block during such a high tapping temperature and long lead time process, and accordingly, the well block needs to be cleaned with oxygen with increased frequency, possibly shortening the life of the well block and lowering the yield because of residual steel in the ladle.

SUMMARY OF THE INVENTION

An object of the present invention is to provide a filler sand for a ladle tap hole valve which filler sand ensures a high free opening ratio even during a high tapping temperature and long lead time process involving ladle refining without shortening the life of a well block or entailing reduction in the yield.

According to a first aspect of the present invention, there is provided a filler sand for a ladle tap hole valve which contains 70 to 90 wt % of chromite sand and 10 to 30 wt % of silica sand and is blended externally with 0.05 to 5 wt % of carbon black calculated based on a total amount of the chromite sand and the silica sand.

The above filler sand is preferably blended with 0.05 to 1 wt % of carbon black calculated based on the total amount of the chromite sand and the silica sand. Also, preferably, 95% or more of the chromite sand consists of particles having particle diameters falling within a range of 150 to 850 $\mu$m, 60% or more of the chromite sand consists of particles having particle diameters falling within a range of 200 to 425 $\mu$m, 95% or more of the silica sand consists of particles having particle diameters falling within a range of 200 to 850 $\mu$m, and 60% or more of the silica sand consists of particles having particle diameters falling within a range of 300 to 600 $\mu$m. Further, in the above filler sand, the silica sand preferably has a of particle diameter coefficient of 1.4 or less. Preferably, moreover, the chromite sand contains substantially no particles having particle diameters smaller than 53 $\mu$m and substantially no particles having particle diameters exceeding 850 $\mu$m. Still preferably, the silica sand contains substantially no particles having particle diameters smaller than 106 $\mu$m and substantially no particles having particle diameters exceeding 1180 $\mu$m. Further, the carbon black is preferably blended in such a manner that it is coated on the silica sand.

According to a second aspect of the present invention, there is provided a filler sand for a ladle tap hole valve which contains 70 to 90 wt % of chromite sand and 10 to 30 wt % of silica sand, wherein 99% or more of the chromite sand consists of particles having particle diameters falling within a range of 150 to 850 μm, 95% or more of the chromite sand consists of particles having particle diameters falling within a range of 200 to 600 μm, 95% or more of the silica sand consists of particles having particle diameters falling within a range of 150 to 850 μm, and 80% or more of the silica sand consists of particles having particle diameters falling within a range of 200 to 600 μm.

The filler sand according to the second aspect of the present invention is preferably blended externally with 0.05 to 5 wt % of carbon black calculated based on a total amount of the chromite sand and the silica sand. A still preferred content of carbon black is 0.05 to 1 wt %. Also, the carbon black is preferably blended in such a manner that it is coated on the silica sand. Preferably, moreover, the silica sand has a particle diameter coefficient of 1.4 or less.

DETAILED DESCRIPTION OF THE INVENTION

Figure 1:
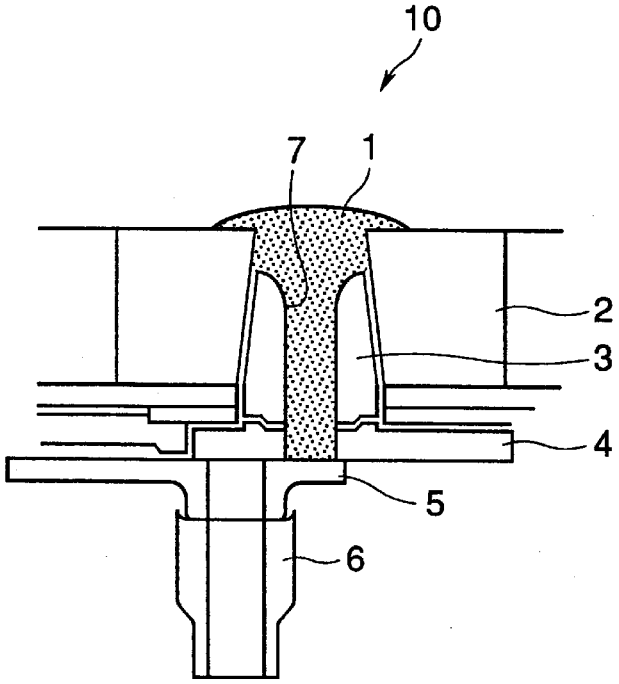
FIG. 1 is a sectional view showing a sliding nozzle as an example of a lade tap hole valve to which a filler sand according to the present invention is applied.

Best Mode for Carrying out the Invention

A filler sand for a ladle tap hole valve according to a first embodiment of the present invention contains 70 to 90 wt % of chromite sand and 10 to 30 wt % of silica sand, and the filler sand is blended externally with 0.05 to 5 wt % of carbon black calculated based on the total amount of the chromite sand and the silica sand.

The inventors hereof made a study of filler sand for use in a ladle tap hole valve which filler sand can maintain a high free opening ratio even during a high tapping temperature and long lead time process at a tapping temperature of 1700° C. or more and a molten steel lead time of 200 minutes or more, corresponding to ladle refining for high-grade steel. As a result of the study, they found that intended properties could be obtained by blending a base material, which constituted chromite sand and silica sand mixed in a certain ratio, with a small amount of carbon black.

Namely, silica sand, which is generally used as a filler sand, is blended with chromite sand in an appropriate ratio so that both the drawback of silica sand, that is, low refractoriness, and the drawback of chromite sand, that is, liability to sintering by molten steel despite its high melting temperature, can be compensated for. The mixture is further blended with carbon black, to thereby prevent the particles of the silica sand or chromite sand from sintering and thus binding together and also to prevent molten steel from penetrating into the filler sand by the penetration preventing property of carbon black. Consequently, an extremely high free opening ratio can be obtained even during a high tapping temperature and long lead time process involving ladle refining.

These effects cannot be obtained by the technique disclosed in Unexamined Japanese Patent Publication No. 4-84664 mentioned above in which carbon black is merely added to silica sand, MgO clinker or zircon sand conventionally used as a filler sand, and can be achieved by a combined effect provided by blending silica sand with chromite sand in an appropriate ratio and by adding a small amount of carbon black.

High-grade steel referred to herein denotes stainless steel, ultra low sulfur steel, bearing steel, etc.

According to the present invention, 70 to 90 wt % chromite sand and 10 to 30 wt % silica sand are blended in these ranges so as to compensate for both the drawback of silica sand, that is, low refractoriness, and the drawback of chromite sand, that is, liability to sintering by molten steel, and thereby increase the free opening ratio. Specifically, chromite sand has a refractoriness of up to about 2150° C., considerably higher than that of silica sand of about 1720° C., and by blending chromite sand with 10 to 30 wt % of silica sand, the problem with chromite sand, that is, liability to sintering, can be solved. Preferred ranges are 75 to 85 wt % for chromite sand and 15 to 25 wt % for silica sand.

The sand mixture is admixed externally with carbon black in the range of 0.05 to 5 wt % calculated based on the total amount of the chromite sand and the silica sand, and adding carbon black in this range serves to prevent the particles of the silica sand or chromite sand from sintering and thus binding together and also to prevent molten steel from penetrating into the filler sand by the penetration preventing property of carbon black.

If the content of carbon black is less than 0.05 wt %, a sufficient effect of preventing the sand particles from binding together is not obtained, and if 5% is exceeded, the pickup amount of carbon into molten steel becomes too large. In the case of making ultra low carbon steel, the pickup amount of carbon into molten steel must be reduced to the smallest possible value, and in such a case the content of carbon black is preferably restricted to 1 wt % or less.

Thus, chromite sand and silica sand are blended in a predetermined ratio to compensate for the drawbacks of these two types of sand and the sintering preventing effect and molten steel penetration preventing effect of carbon black are utilized in combination, whereby an extremely high free opening ratio can be obtained even during a severe process such as a high tapping temperature and long lead time process involving ladle refining, or more specifically, a process at a tapping temperature of 1700° C. or more and a molten steel lead time of 200 minutes or more.

If no carbon black is contained in this embodiment, the filler sand is liable to be sintered to the surface of a well block in cases where the molten steel holding time is longer than 2–3 hours. Thus, the well block needs to be cleaned with oxygen with increased frequency, possibly shortening the life of the well block and causing reduction in the yield because of residual steel in the ladle, but the problem does not arise since carbon black is contained.

Preferably, in this embodiment, 95% or more of the chromite sand consists of particles having particle diameters falling within a range of 150 to 850 μm, 60% or more of the chromite sand consists of particles having particle diameters falling within a range of 200 to 425 μm, 95% or more of the silica sand consists of particles having particle diameters falling within a range of 200 to 850 μm, and 60% or more of the silica sand consists of particles having particle diameters falling within a range of 300 to 600 μm. By setting the particle diameter distributions in this manner, excessive production of sintered layer, bridging induced by thermal expansion, and penetration of slag or steel can be prevented more effectively, that is, the degree of sintering and the molten steel penetrating property can be reduced to an even lower level, thereby greatly increasing the free opening ratio.

To enhance the advantageous effects, preferably, the chromite sand contains substantially no particles having particle diameters smaller than 53 μm and/or substantially no particles having particle diameters exceeding 850 μm, and the silica sand contains substantially no particles having particle diameters smaller than 106 μm and/or substantially no particles having particle diameters exceeding 1180 μm; in this case, nearly 100% free opening ratio can be achieved.

The particle size distribution is obtained based on the values measured in conformity with a particle size determination method (Z2602) for molding sand as provided by JIS. According to this method, sieves are stacked up in order of nominal size such that the coarsest sieve is located on top, and with a material put on the uppermost sieve, that is, on the coarsest sieve, the material is sieved using a screening machine such as a law-tap-type screening machine.

A second embodiment of the present invention will be now described.

A filler sand for a ladle tap hole valve according to the second embodiment of the present invention contains 70 to 90 wt % of chromite sand and 10 to 30 wt % of silica sand, wherein 99% or more of the chromite sand consists of particles having particle diameters falling within a range of 150 to 850 μm, 95% or more of the chromite sand consists of particles having particle diameters falling within a range of 200 to 600 μm, 95% or more of the silica sand consists of particles having particle diameters falling within a range of 150 to 850 μm, 80% or more of the silica sand consists of particles having particle diameters falling within a range of 200 to 600 μm.

In the first embodiment described above, to obtain a filler sand for a ladle tap hole valve which can maintain a high free opening ratio even during a high tapping temperature and long lead time process involving ladle refining, a base material, which consists of chromite sand and silica sand mixed in a certain ratio, is blended with a small amount of carbon black and also the preferred particle diameter distributions for the sands are defined as stated above. In this embodiment, by contrast, the particle diameter distributions of the chromite sand and the silica sand are limited to respective specified ranges different from those of the preferred particle diameter distributions of the foregoing embodiment.

Specifically, silica sand, which is generally used as a filler sand, is blended with chromite sand in the same ratio as that of the first embodiment, and the particle diameter distributions of the sands are limited to the aforementioned respective specified ranges, whereby both the drawback of silica sand, that is, low refractoriness, and the drawback of chromite sand, that is, liability to sintering by molten steel despite its high melting temperature, can be compensated for, and it is possible to prevent the particles of the silica sand or the chromite sand from sintering and thus binding together and also to prevent molten steel from penetrating into the filler sand by the penetration preventing effect. Consequently, an extremely high free opening ratio can be achieved even during a high tapping temperature and long lead time process involving ladle refining.

In this embodiment, 99% or more of the chromite sand consists of particles having particle diameters falling within a range of 150 to 850 μm, 95% or more of the chromite sand consists of particles having particle diameters falling within a range of 200 to 600 μm, 95% or more of the silica sand consists of particles having particle diameters falling within a range of 150 to 850 μm, and 80% or more of the silica sand consists of particles having particle diameters falling within a range of 200 to 600 μm. Thus, the chromite sand has a steep particle diameter distribution in which particles with diameters ranging from 200 to 600 μm account for an especially large part, and the silica sand also has a relatively steep particle diameter distribution in which particles with diameters ranging from 200 to 600 μm account for an especially large part, whereby the mixing uniformity and filling characteristics of the two types of sand are improved, and it s possible to effectively prevent excessive production of sintered layer, bridging induced by thermal expansion and penetration of slag or steel in particular, and also to greatly increase the free opening ratio even though no carbon black is contained.

The particle diameter distributions of the first embodiment are based on an idea of having coarse particles, which are considered to be low in the degree of sintering, contained in the filler sand to a certain extent to allow fine particles to be located between coarse particles, thereby ensuring the mixing uniformity and the filling characteristics. In this embodiment, by contrast, the amount of relatively fine particles having diameters ranging from 200 to 600 μm is increased in particular to effectively prevent the penetration of molten steel. Namely, by setting the particle diameter distributions in this manner, voids created when the filler sand is filled can be made small, thereby further enhancing the mixing characteristics and greatly reducing the penetration of molten steel, and as a consequence, an extremely high free opening ratio can be obtained even though no carbon black is contained.

The peak in the particle diameter distribution of the chromite sand is preferably close to that in the particle diameter distribution of the silica sand, or more specifically, the two peaks are preferably within a range of 100 μm, whereby voids created when the filler sand is filled can be made even smaller.

Thus, the particle diameter distributions of this embodiment can ensure an extremely high free opening ratio, but in view of a high tapping temperature and long lead time process for high-grade steel which involves ladle refining of a molten steel lead time of 300 minutes or more, the filler sand is preferably blended externally with 0.05 to 5 wt % of carbon black calculated based on the total amount of the chromite sand and the silica sand. By adding carbon black in this range, it is possible to prevent the particles of the silica sand or the chromite sand from sintering and thus binding together, and also to effectively prevent molten steel from penetrating into the filler sand by the penetration preventing effect of carbon black. Where carbon black is contained, an extremely high free opening ratio can be achieved under any operating conditions. Also in this embodiment, where carbon black is to be added, the amount of carbon black is preferably limited to 1 wt % or less, in order to minimize the pickup amount of carbon by molten steel.

In both of the above embodiments, the smaller the particle diameter of the silica sand, the lower the refractoriness becomes, and to prevent this, silica sand having a particle diameter coefficient of 1.4 or less is preferably used. Silica sand having a particle diameter coefficient of 1.4 or less is less liable to remain in the nozzle, and thus the need for removal of bridging can be greatly reduced. A more preferred range of the particle diameter coefficient is 1.3 to 1.

The particle diameter coefficient referred to herein represents a value calculated using a sand surface area measuring instrument (manufactured by George-Fisher Corporation). Specifically, the particle diameter coefficient represents a value obtained by dividing a surface area (specific surface area) per 1 g of actual sand by a theoretical specific surface. The theoretical specific surface denotes a specific surface based on the assumption that all sand particles are spherical in shape. Accordingly, rounder particles have a particle diameter coefficient closer to 1. Preferably, in view of the mixing uniformity, the chromite sand also has a particle diameter coefficient of 1.4 or less.

The chromite sand used in the present invention is not particularly limited and may be obtained by subjecting naturally occurring chromite sand as a raw material to drying, classifying, etc., or alternatively, naturally occurring chromite sand may be directly used. Chromite sand, though its composition varies depending on the place of production, generally contains 30 wt % or more $Cr_2O_3$, preferably 30 to 60 wt % $Cr_2O_3$. For example, typical chromite sand contains 40 to 50 wt % of $Cr_2O_3$, 20 to 30 wt % of FeO, about 15 wt % of $Al_2O_3$ and about 10 wt % of MgO. Usually, the particle diameter coefficient of chromite sand is 1.4 or less.

The silica sand to be used is also not particularly limited and may be obtained by subjecting naturally occurring silica sand as a raw material to drying, classifying, etc.; alternatively, naturally occurring silica sand may be directly used. The composition of silica sand also varies depending on the place of production, and it generally contains 90 wt % or more $SiO_2$. As such natural sand, Fremantle sand from Australia or domestic silica sand from the Tohoku region, for example, may be used. Silica sand may contain substances such as $Al_2O_3$, $K_2O$, $Na_2O$, etc., but since these substances lower the melting point of the silica sand and are a cause of the failure to make an opening, the substances, if contained, should preferably be limited to 1 wt % or less.

To make the quality of the chromite sand and of the silica sand constant, sand which has been subjected to grinding may be used. Also, two or more types of ground or unground sands may be mixed.

For such grinding, either a dry process or a wet process, both conventionally known, may be adopted. The dry grinding process includes a process using a pneumatic scrubber such as Sand reclaimer in which a sand material is blown up by a high-speed air flow to collide against a collision plate so that the sand particles may be ground by mutual collision and friction, and a process using a high-speed agitator such as an agitator mill in which sand is ground by friction. The wet grinding process, on the other hand, includes a process using a trough-type grinder in which blades are rotated so that sand particles in the trough may be ground by mutual friction.

Of these dry and wet grinding processes, the wet process is preferred because, where the wet process is adopted, sand particles smaller in size than a desired particle size can be removed at the same time as they are washed in water during the grinding process. Even in the case where the dry process is employed, a similar effect can be obtained by using a water washing device in combination.

The ladle tap hole valve to which the filler sand of the present invention is applied includes a sliding nozzle and a rotary nozzle, the shape of which is not particularly limited. Also, there is no particular restriction on the type of molten steel to be used.

The filler sand of the present invention may be of any form insofar as the sands are blended in the aforementioned ratio. In cases where carbon black is to be added, however, carbon black is preferably mixed in advance with a binder or the like so that it may have a suitable viscosity, and is coated on the surface of the silica sand, and the silica sand thus coated with carbon black is uniformly mixed with the chromite sand. This permits carbon black to be uniformly dispersed and also more effectively prevents sintering of the silica sand. The term "coat" means herein causing carbon black particles to adhere to the surfaces of the silica sand particles, and it does not necessarily mean forming a layer of carbon black. Carbon black may alternatively be coated on the chromite sand or be coated on both of the silica sand and the chromite sand.

FIG. 1 shows a structure of a sliding nozzle, as an example of the ladle tap hole valve to which the filler sand of the present invention is applied. A sliding nozzle 10 comprises an upper nozzle 3, a well block 2 laterally supporting the upper nozzle, a fixed plate 4 supporting the upper nozzle 3 from below, a slide plate 5 slidable relative to the fixed plate 4, and a lower nozzle 6 attached to the bottom of the slide plate 5. A filler sand 1 according to the present invention is filled in a nozzle hole 7 defined by the upper nozzle 3. With the sliding nozzle 10 closed as illustrated in the figure, molten steel is poured into the ladle. After the molten steel is poured, the slide plate 5 is moved, whereby the sliding nozzle opens. Consequently, the filler sand falls and the nozzle hole 7 opens by itself. A rotary nozzle has a basic structure similar to that of the sliding nozzle and differs therefrom only in that the slide plate is rotatable.

The filler sand of the present invention used in this manner is less liable to sinter and also the penetration of molten steel is less liable to occur even during a high tapping temperature and long lead time process involving ladle refining, as stated above, whereby an extremely high free opening ratio can be maintained.

EXAMPLES

Specific examples according to the present invention will be now described.

Example 1

In the following, examples corresponding to the first embodiment will be explained.

Each of filler sands obtained by blending chromite sand, silica sand and carbon black in respective ratios shown in Table 1 was filled in the nozzle hole of 75 mmϕ in nozzle diameter of a ladle tap hole valve arranged at the bottom of a 250-ton ladle, and a free opening ratio for 1000 charges was measured. In Test 1, ordinary continuous casting was performed for almost all charges, and Test 2 was conducted under 10% severer conditions of a tapping temperature of 1700° C. or more and a molten steel lead time of 200 minutes or more, corresponding to ladle refining for high-grade steel such as stainless steel, ultra low sulfur steel, bearing steel, etc. The free opening ratio obtained in these tests are shown in Table 1. Symbols in the columns "Particle Diameter Distribution of Chromite Sand" and "Particle Diameter Distribution of Silica Sand" of Table 1 represent respective particle diameter distributions shown in Tables 2 and 3. The carbon black used had an average particle diameter of 40 nm. The chromite sand and the silica sand had a particle diameter coefficient of about 1.3.

Among the examples satisfying the ranges of the present invention, Sample Nos. 2 to 4 and 6 to 14 showed a high free opening ratio of 99.4% or more in both of Tests 1 and 2. Particularly, Sample Nos. 2 to 4 and 6 to 8 of which the chromite particles and the silica particles had particle diameter distributions falling within respective preferred ranges showed excellent results, and among these, Sample Nos. 2 to 4 containing smaller amounts of coarse particles and fine particles showed a 100% free opening ratio in both tests. In the samples containing 0.5 wt % carbon black, the pickup amount of carbon into molten steel was nearly zero, proving that these fillers could be used in making ultra low carbon steel.

Figure 2:
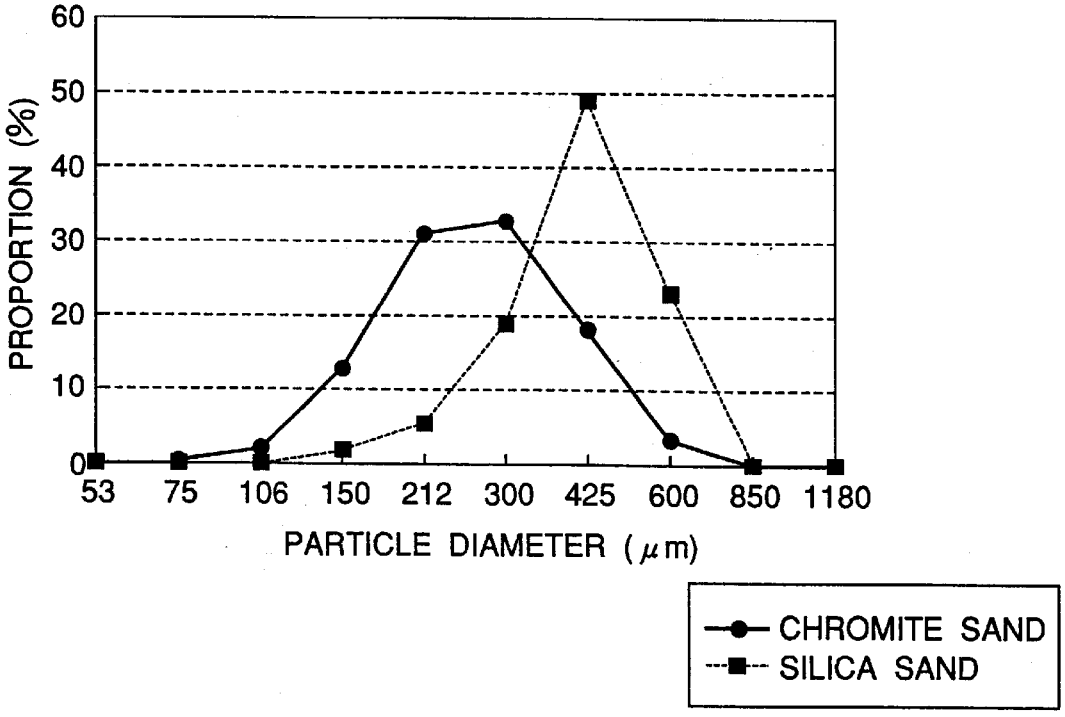
FIG. 2 is a graph showing, by way of example, particle diameter distributions of chromite sand and silica sand according to a first embodiment of the present invention.

FIG. 2 shows the particle diameter distributions of the chromite sand and the silica sand used in Sample Nos. 2 to 4.

By contrast, Sample No. 1, which contained chromite sand and silica sand in a ratio falling within the range of the present invention but no carbon black and of which the chromite sand and the silica sand had particle diameter distributions falling within the respective preferred ranges, showed an excellent free opening ratio in Test 1 but a somewhat low free opening ratio of 99.8% in Test 2. Also, this filler sand was sintered to the surface of the well block with high frequency and the frequency of cleaning the well block with oxygen was high. Sample No. 5 having a large carbon black content showed an excellent free opening ratio but was found to be unsuitable for actual use because of a large pickup amount of carbon by molten steel.

Sample Nos. 15 to 17 containing chromite sand and silica sand in ratios outside the range of the present invention and Sample Nos. 18 to 23 having carbon black added to chromite sand alone or to silica sand alone failed to show a high free opening ratio in Tests 1 and 2, though carbon black was added.

From these results, it was confirmed that by blending chromite sand, silica sand and carbon black in an appropriate ratio, a high free opening ratio could be obtained even during a high tapping temperature and long lead time process involving ladle refining at a tapping temperature of 1700° C. or more and a molten steel lead time of 200 minutes or more.

TABLE 1

| Sample No. | Blend Ratio (wt %) Chromite Sand | Blend Ratio (wt %) Silica Sand | Carbon Black (wt %) | Particle Diameter Distribution of Chromite Sand | Particle Diameter Distribution of Silica Sand | Free opening Ratio (%) Test 1 | Free opening Ratio (%) Test 2 | Remarks |
|---|---|---|---|---|---|---|---|---|
| 1 | 80 | 20 | 0 | A | a | 100 | 99.8 | Comparative Example |
| 2 | 80 | 20 | 0.1 | A | a | 100 | 100 | Example |
| 3 | 80 | 20 | 0.5 | A | a | 100 | 100 | Example |
| 4 | 80 | 20 | 3 | A | a | 100 | 100 | Example |
| 5 | 80 | 20 | 6 | A | a | 100 | 99.8 | Comparative Example |
| 6 | 80 | 20 | 0.1 | B | b | 99.8 | 99.8 | Example |
| 7 | 80 | 20 | 0.5 | B | b | 99.8 | 99.8 | Example |
| 8 | 80 | 20 | 3 | B | b | 99.8 | 99.8 | Example |
| 9 | 80 | 20 | 0.1 | A | c | 99.4 | 99.4 | Example |
| 10 | 80 | 20 | 0.5 | A | c | 99.4 | 99.4 | Example |
| 11 | 80 | 20 | 3 | A | c | 99.4 | 99.4 | Example |
| 12 | 80 | 20 | 0.1 | C | a | 99.4 | 99.4 | Example |
| 13 | 80 | 20 | 0.5 | C | a | 99.4 | 99.4 | Example |
| 14 | 80 | 20 | 3 | C | a | 99.4 | 99.4 | Example |
| 15 | 60 | 40 | 0.1 | A | a | 99.0 | 98.8 | Comparative Example |
| 16 | 60 | 40 | 0.5 | A | a | 99.0 | 98.8 | Comparative Example |
| 17 | 60 | 40 | 3 | A | a | 99.0 | 98.8 | Comparative Example |
| 18 | 0 | 100 | 0.1 | — | a | 98.2 | 98.0 | Comparative Example |
| 19 | 0 | 100 | 0.5 | — | a | 98.2 | 98.0 | Comparative Example |
| 20 | 0 | 100 | 3 | — | a | 98.2 | 98.0 | Comparative Example |
| 21 | 100 | 0 | 0.1 | A | — | 98.8 | 98.6 | Comparative Example |
| 22 | 100 | 0 | 0.5 | A | — | 98.8 | 98.6 | Comparative Example |
| 23 | 100 | 0 | 3 | A | — | 98.8 | 98.6 | Comparative Example |

TABLE 2

| | Particle Diameter Distribution of Chromite Sand (%) | | | | | | | | | |
|---|---|---|---|---|---|---|---|---|---|---|
| | >850 μm | >600 μm | >425 μm | >300 μm | >212 μm | >150 μm | >106 μm | >75 μm | >53 μm | ≦53 μm |
| A | — | 3.0 | 18.4 | 32.7 | 30.7 | 13.2 | 1.6 | 0.3 | 0.1 | — |
| B | 0.1 | 0.3 | 2.6 | 14.0 | 39.9 | 34.6 | 7.8 | 0.7 | 0.2 | 0.1 |
| C | 3.0 | 5.2 | 17.5 | 28.5 | 30.2 | 12.4 | 3.0 | 0.1 | 0.1 | — |

TABLE 3

| | Particle Diameter Distribution of Silica Sand (%) | | | | | | | |
|---|---|---|---|---|---|---|---|---|
| | >850 μm | >600 μm | >425 μm | >300 μm | >212 μm | >150 μm | >106 μm | ≦106 μm |
| a | — | 23.1 | 49.7 | 19.1 | 6.0 | 1.5 | 0.1 | — |
| b | 1.8 | 30.5 | 44.5 | 19.6 | 3.2 | 0.5 | 0.1 | 0.1 |
| c | 3.8 | 28.5 | 40.4 | 21.7 | 3.2 | 2.0 | 0.1 | 0.1 |

Example 2

In the following, examples corresponding to the second embodiment will be explained.

Figure 3:
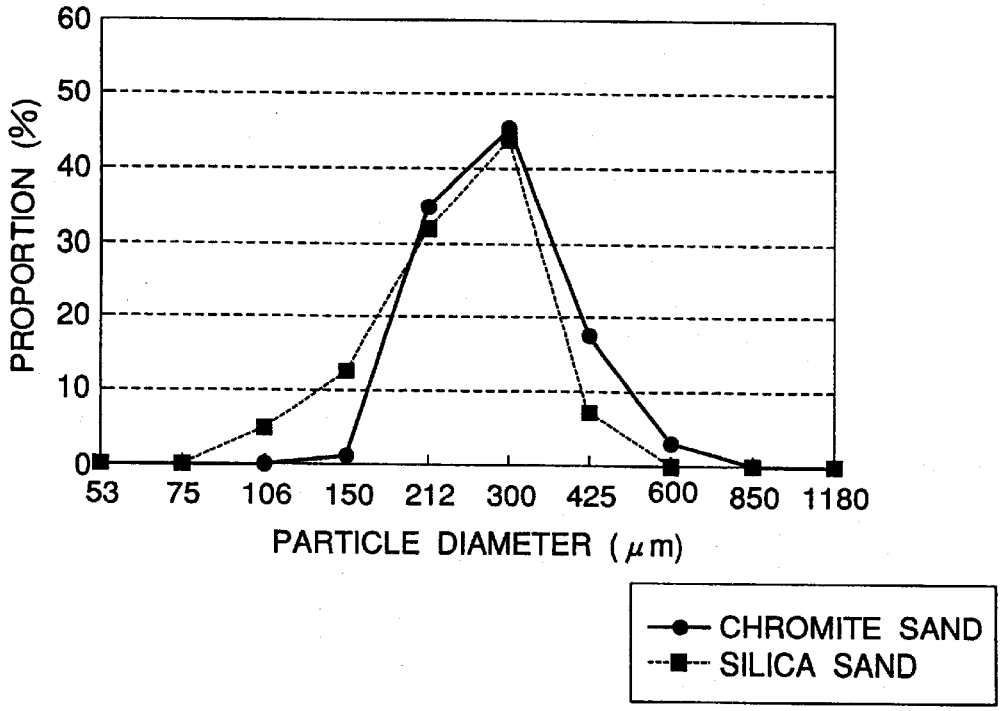
FIG. 3 is a graph showing, by way of example, particle diameter distributions of chromite sand and silica sand according to a second embodiment of the present invention.

A filler sand of Sample No. 24, obtained by blending chromite sand having a particle diameter coefficient of about 1.3 with silica sand in a ratio shown in Table 4, was filled in the nozzle hole of 75 mmϕ in nozzle diameter of the ladle tap hole valve arranged at the bottom of the 250-ton ladle, and the free opening ratio for 1000 charges was measured. In this case, test was conducted for all charges under severe conditions of a tapping temperature of 1700° C. or more and a molten steel lead time of 200 minutes or more, corresponding to ladle refining for high-grade steel. As a result, the free opening ratio was found to be 100%. FIG. 3 shows the respective particle diameter distributions of the chromite sand and the silica sand used in this sample.

Figure 4:
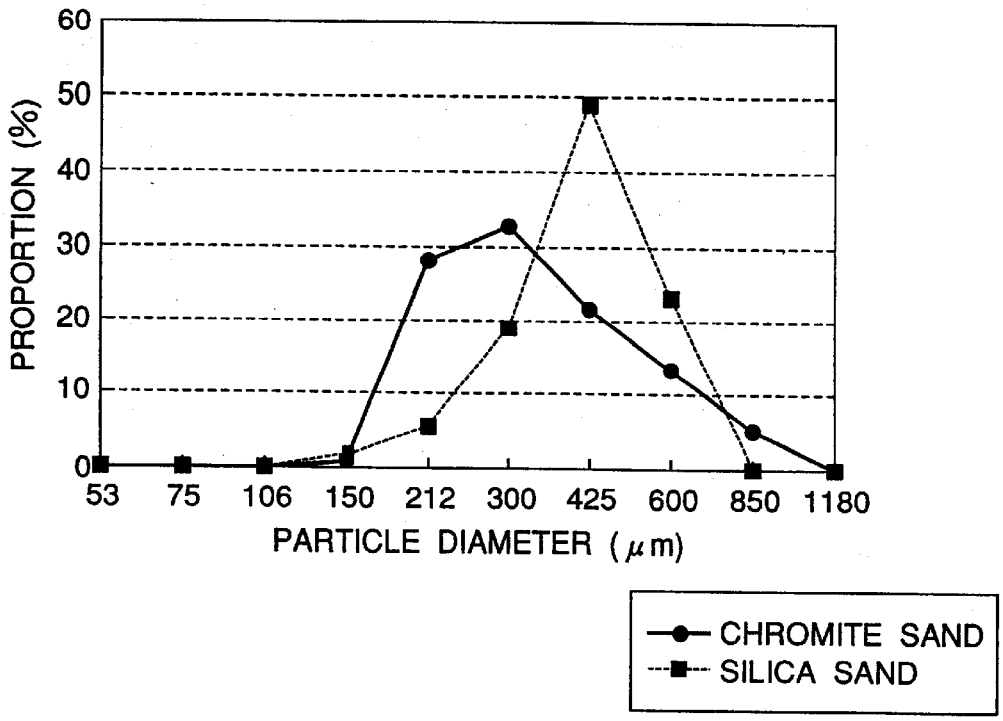
FIGS. 4 and 5 are graphs each showing particle diameter distributions of chromite sand and silica sand according to a comparative example in contrast to the second embodiment of the present invention.
Figure 5:
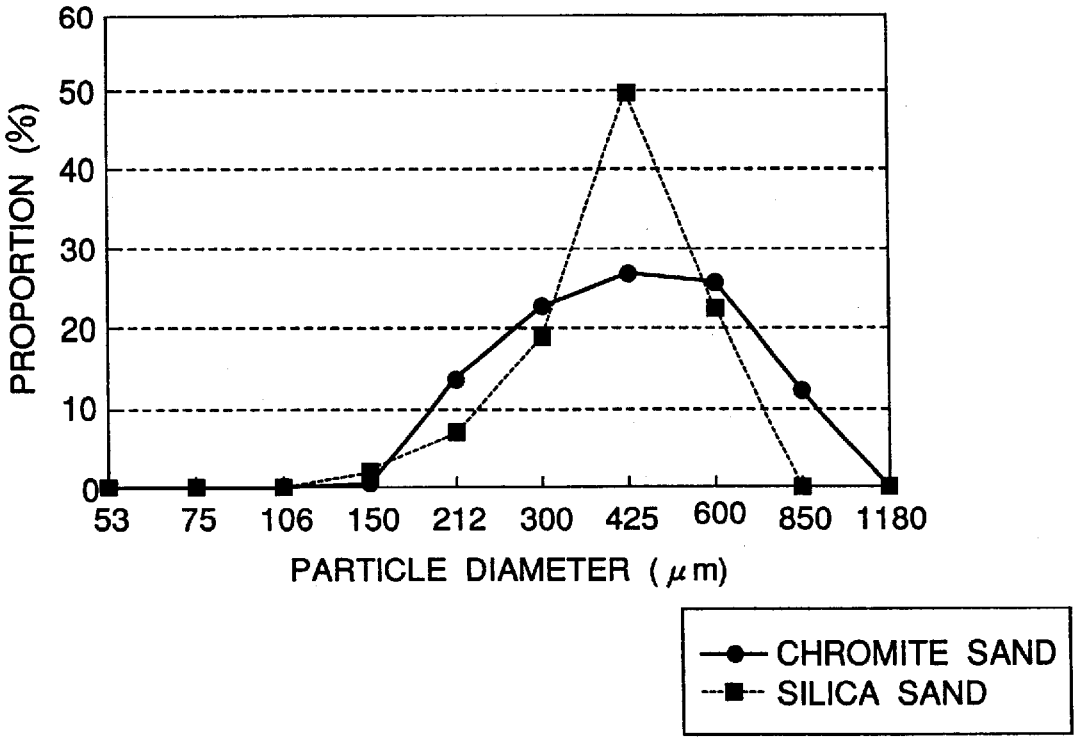

For the purpose of comparison, filler sands of Sample Nos. 25 and 26, containing larger amounts of coarse particles than Sample No. 24 and having particle diameter distributions shown in Table 5, were each similarly filled in the nozzle hole of 75 mmϕ in nozzle diameter of the ladle tap hole valve arranged at the bottom of the 250-ton ladle, and the free opening ratio was measured under the same conditions. As a result, the samples showed an insufficient free opening ratio of 98.5%. FIGS. 4 and 5 show the particle diameter distributions of the chromite sand and the silica sand used in Sample Nos. 25 and 26, respectively.

Subsequently, filler sands identical with that of Sample No. 24 and blended externally with 0.1%, 0.5% and 3% of carbon black, respectively, were prepared, and were each filled in the nozzle hole of 75 mmϕ in nozzle diameter of the ladle tap hole valve arranged at the bottom of the 250-ton ladle, and the free opening ratio was measured for 1000 charges under conditions of a tapping temperature of 1700° C. or more and a molten steel lead time of 300 minutes or more, corresponding to an even severer one of ladle refining processes for high-grade steel. As a result of the measurement, all filler sands showed a free opening ratio of 100%.

TABLE 4

| Sample No. | | Blend Ratio (wt %) | Particle diameter distribution (%) >850 μm | >600 μm | >425 μm | >300 μm | >212 μm | >150 μm | >106 μm | ≦106 μm |
|---|---|---|---|---|---|---|---|---|---|---|
| 24 | Chromite Sand | 80 | — | 2.3 | 16.5 | 45.5 | 34.9 | 0.7 | 0.1 | — |
| | Silica Sand | 20 | — | — | 7.2 | 44.2 | 32.1 | 12.3 | 4.2 | — |

TABLE 5

| Sample No. | | Blend ratio (wt %) | Particle diameter distribution (%) >850 μm | >600 μm | >425 μm | >300 μm | >212 μm | >150 μm | >106 μm | ≦106 μm |
|---|---|---|---|---|---|---|---|---|---|---|
| 25 | Chromite Sand | 80 | 4.3 | 13.3 | 21.7 | 33 | 26.9 | 0.6 | 0.2 | — |
| | Silica Sand | 20 | — | 23.1 | 49.7 | 19.1 | 6 | 1.5 | 0.1 | — |
| 26 | Chromite Sand | 80 | 11.9 | 25.9 | 26.3 | 22 | 13.6 | 0.3 | — | — |
| | Silica Sand | 20 | — | 23.1 | 49.7 | 19.1 | 6 | 1.5 | 0.1 | — |

What is claimed is:

1. A filler sand for a ladle tap hole valve comprising 70 to 90 wt % of chromite sand and 10 to 30 wt % of silica sand, said filler sand being blended externally with 0.05 to 5 wt % of carbon black calculated on a total amount of the chromite said and the silica sand, wherein 95% or more of the chromite sand consists of particles having particle diameters within a range of 150 to 850 μm, 60% or more of the chromite sand consists of particles having particle diameters within a range of 200 to 425 μm, 95% or more of the silica sand consists of particles having particle diameters within a range of 200 to 850 μm, and 60% or more of the silica sand consists of particles having particle diameters within a range of 300 to 600 μm.

2. The filler sand according to claim 1, wherein said filler sand is blended with 0.05 to 1 wt % of carbon black calculated based on the total amount of the chromite sand and the silica sand.

3. The filler sand according to claim 1, wherein the silica sand has a particle diameter coefficient of 1.4 or less.

4. The filler sand according to claim 1, wherein the chromite sand contains substantially no particles having particle diameters smaller than 53 $\mu$m.

5. The filler sand according to claim 1, wherein the chromite sand contains substantially no particles having particle diameters exceeding 850 $\mu$m.

6. The filler sand according to claim 1, wherein the silica sand contains substantially no particles having particle diameters smaller than 106 $\mu$m.

7. The filler sand according to claim 1, wherein the silica sand contains substantially no particles having particle diameters exceeding 1180 $\mu$m.

8. The filler sand according to claim 1, wherein the carbon black is blended in such a manner that it is coated on the silica sand.

9. The filler sand according to claim 1, wherein the chromite sand is in an amount of 75 to 85 wt % and the silica sand is in an amount of 15 to 25 wt %.

10. The filler sand according to claim 1, wherein the silica sand has a particle diameter coefficient of 1.3 to 1.

11. The filler sand according to claim 10, wherein the chromite sand has a particle diameter coefficient of 1.4 or less.

12. The filler sand according to claim 11, wherein the chromite sand has a composition of 40 to 50 wt % $Cr_2O_3$, 20 to 30 wt % FeO, 15 wt % $Al_2O_3$ and 10 wt % MgO.

13. A filler sand for a ladle top hole valve containing 70 to 90 wt % of chromite sand and 10 to 30 wt % of silica sand, wherein 99% or more of the chromite sand consists of particles having particle diameters within a range of 150 to 180 $\mu$m, 95% or more of the chromite sand consists of particles having particle diameters within a range of 200 to 600 $\mu$m, 95% or more of the silica sand consists of particles having particle diameters within a range of 150 to 850 $\mu$m, and 80% or more of the silica sand consists of particles having particle diameters within a range of 200 to 600 $\mu$m.

14. The filler sand according to claim 13, wherein said filler sand is blended externally with 0.05 to 5 wt % of carbon black calculated based on a total amount of the chromite sand and the silica sand.

15. The filler sand according to claim 14, wherein said filler sand is blended with 0.05 to 1 wt % of carbon black calculated based on the total amount of the chromite sand and the silica sand.

16. The filler sand according to claim 13, wherein the carbon black is blended in such a manner that it is coated on the silica sand.

17. The filler sand according to claim 13, wherein the silica sand has a particle diameter coefficient of 1.4 or less.

18. The filler sand according to claim 13, wherein the chromite sand is in an amount of 75 to 85 wt % and the silica sand is in an amount of 15 to 25 wt %.

19. The filler sand according to claim 13, wherein the silica sand has a particle diameter coefficient of 1.3 to 1 and the chromite sand has a particle diameter coefficient of 1.4 or less.

20. The filler sand according to claim 19, wherein the filler sand is blended externally with 0.05 to 1 wt % of carbon black calculated based on the total amount of the chromite sand and the silica sand.

* * * * *